US007341429B2

(12) United States Patent
Montgomery et al.

(10) Patent No.: US 7,341,429 B2
(45) Date of Patent: Mar. 11, 2008

(54) METHODS AND APPARATUSES FOR COOLING GAS TURBINE ENGINE ROTOR ASSEMBLIES

(75) Inventors: Julius John Montgomery, Mason, OH (US); Robert Proctor, West Chester, OH (US); Nathan Gerard Cormier, Cincinnati, OH (US); Christopher Charles Glynn, Hamilton, OH (US); Glen William Royal, Cincinnati, OH (US); Richard William Jendrix, Liberty Township, OH (US)

(73) Assignee: General Electric Company, Schenectady, NY (US)

( * ) Notice: Subject to any disclaimer, the term of this patent is extended or adjusted under 35 U.S.C. 154(b) by 199 days.

(21) Appl. No.: 11/280,439

(22) Filed: Nov. 16, 2005

(65) Prior Publication Data

US 2007/0110565 A1 May 17, 2007

(51) Int. Cl.
*F03B 11/00* (2006.01)

(52) U.S. Cl. ..... 416/97 R; 415/115; 415/170.1

(58) Field of Classification Search ..... 415/115, 415/170.1; 416/97 R
See application file for complete search history.

(56) References Cited

U.S. PATENT DOCUMENTS

| | | | | |
|---|---|---|---|---|
| 3,565,545 | A * | 2/1971 | Bobo et al. | 416/90 R |
| 4,466,239 | A * | 8/1984 | Napoli et al. | 415/116 |
| 5,333,402 | A * | 8/1994 | Weir | 271/85 |
| 5,402,636 | A * | 4/1995 | Mize et al. | 415/115 |
| 5,816,776 | A * | 10/1998 | Chambon et al. | 415/174.5 |
| 5,855,112 | A | 1/1999 | Bannai et al. | |
| 6,506,015 | B2 | 1/2003 | Nagata et al. | |
| 6,513,335 | B2 | 2/2003 | Fukutani | |
| 6,537,028 | B1 | 3/2003 | Izumi et al. | |
| 6,776,573 | B2 * | 8/2004 | Arilla et al. | 415/115 |
| 6,905,310 | B2 | 6/2005 | Kawamoto et al. | |
| 2001/0047651 | A1 | 12/2001 | Fukutani | |
| 2004/0005220 | A1 | 1/2004 | Kawamoto et al. | |
| 2005/0079050 | A1 | 4/2005 | Kokusho | |

* cited by examiner

*Primary Examiner*—Igor Kershteyn
(74) *Attorney, Agent, or Firm*—William Scott Andes; Armstrong Teasdale LLP

(57) ABSTRACT

A method of manufacturing a gas turbine engine includes providing a turbine mid-frame, coupling a plurality of rotor blades to a rotor disk, the rotor disk is coupled axially aft from the turbine mid-frame such that a cavity is defined between the rotor disk and the turbine mid-frame, and forming at least one opening extending through the turbine mid-frame to facilitate channeling cooling air into the gap, the opening configured to impart a high relative tangential velocity into the cooling air discharged from the opening.

18 Claims, 7 Drawing Sheets

METHODS AND APPARATUSES FOR COOLING GAS TURBINE ENGINE ROTOR ASSEMBLIES

BACKGROUND OF THE INVENTION

This invention relates generally to gas turbine engines and, more particularly, to methods and apparatuses for reducing turbine rotor temperatures.

Gas turbine engines typically include a compressor, a combustor, and a high-pressure turbine. In operation, air flows through the compressor and the compressed air is delivered to the combustor wherein the compressed air is mixed with fuel and ignited. The heated airflow is then channeled through the high-pressure turbine to facilitate driving the compressor. Moreover, during operation, uncooled high-pressure turbine blades may transfer heat from the turbine blades, at gas path temperature, through the shank, and by conduction and/or convection, to the high-pressure turbine disk. Furthermore, cooling flow lost due to shank leaks my allow combustion gases to enter the cooling circuit, exposing the turbine disk to combustion gas temperatures. As a result, the turbine disk is exposed to high temperatures which may thermally fatigue the turbine disk.

To facilitate preventing damage that may result from turbine disk exposure to high temperatures and possibly combustion gases, at least one known gas turbine engine includes an internal cooling circuit to facilitate cooling the turbine disk. More specifically, cooling air is channeled along a forward face of the disk from a radially inner portion of the disk along a substantially linear path to a radially outer portion of the disk. However, channeling the cooling air linearly along the face of the rotor disk may not effectively cool the disk. Moreover, various fasteners and/or blade retainer pins within the cooling flowpath create undesired temperature rise due to windage, which may further reduce the ability for the cooling air to effectively cool the turbine disk.

BRIEF DESCRIPTION OF THE INVENTION

In one aspect, a method of manufacturing a gas turbine engine is provided. The method includes providing a turbine mid-frame, coupling a plurality of rotor blades to a rotor disk, the rotor disk is coupled axially aft from the turbine mid-frame such that a cavity is defined between the rotor disk and the turbine mid-frame, and forming at least one opening extending through the turbine mid-frame to facilitate channeling cooling air into the gap, the opening configured to impart a significant tangential velocity relative to the disk (swirl) in the cooling air discharged from the opening.

In another aspect, a turbine mid-frame assembly is provided. The turbine mid-frame assembly includes a turbine mid-frame including at least one of a fastener cover plate and an opening extending through the turbine mid-frame configured to facilitate cooling a turbine coupled downstream from and adjacent to the turbine mid-frame.

In a further aspect, a gas turbine engine is provided. The gas turbine engine includes a rotor disk, a plurality of blades coupled to the rotor disk, and a plurality of blade retaining devices coupled to an aft face of the rotor disk and the plurality of blades, the blade retaining devices configured to secure the plurality of blades to the rotor disk.

DETAILED DESCRIPTION OF THE INVENTION

Figure 1:
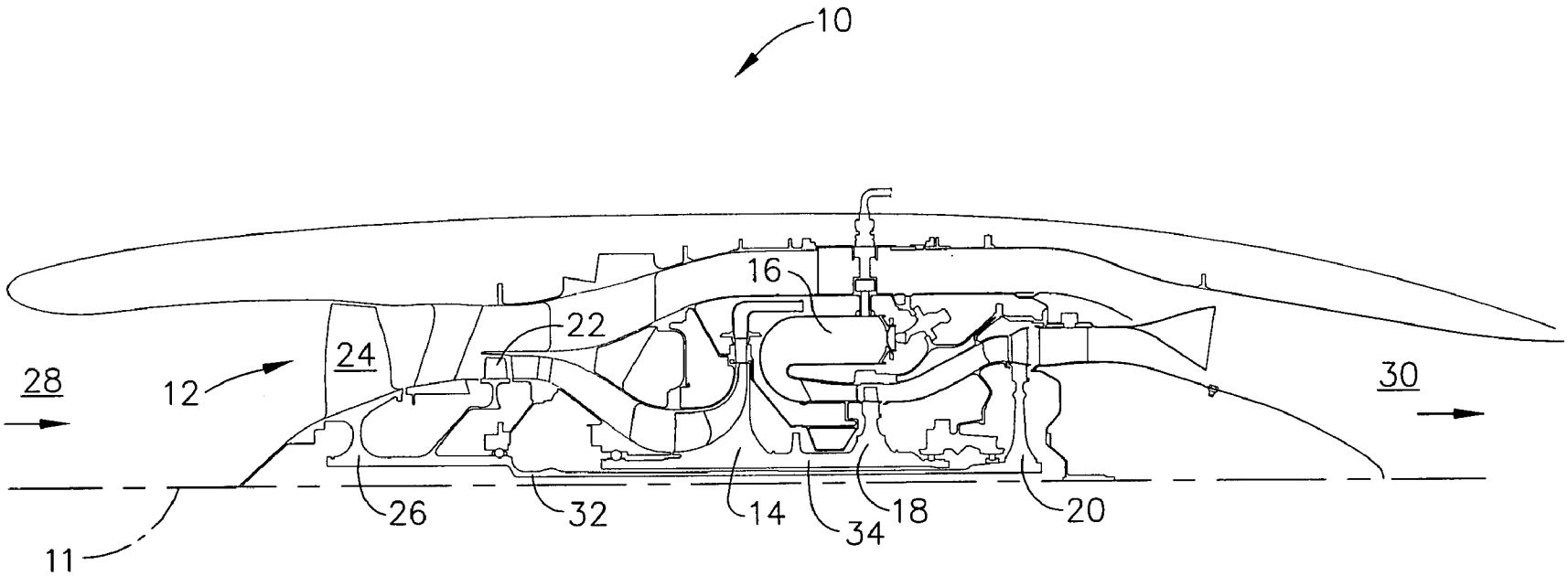
FIG. 1 is schematic illustration of an exemplary gas turbine engine.

FIG. 1 is a schematic illustration of an exemplary gas turbine engine assembly 10 having a longitudinal axis 11. Gas turbine engine assembly 10 includes a fan assembly 12, a high-pressure radial compressor 14, and a combustor 16. Engine 10 also includes a high-pressure turbine assembly 18, a low-pressure turbine 20, and a booster 22. Fan assembly 12 includes an array of fan blades 24 extending radially outward from a rotor disk26. Engine 10 has an intake side 28 and an exhaust side 30. Fan assembly 12, booster 22, and low-pressure turbine 20 are coupled together by a first rotor shaft 32, and compressor 14 and high-pressure turbine assembly 18 are coupled together by a second rotor shaft 34.

In operation, air flows through fan assembly 12 and compressed air is supplied to high-pressure compressor 14 through booster 22. The highly compressed air is delivered to combustor 16. Hot products of combustion from combustor 16 are utilized to drive turbines 18 and 20, which in turn drive fan assembly 12 and booster 22 utilizing first rotor shaft 32, and also drive high-pressure compressor 14 utilizing second rotor shaft 34, respectively.

Figure 2:
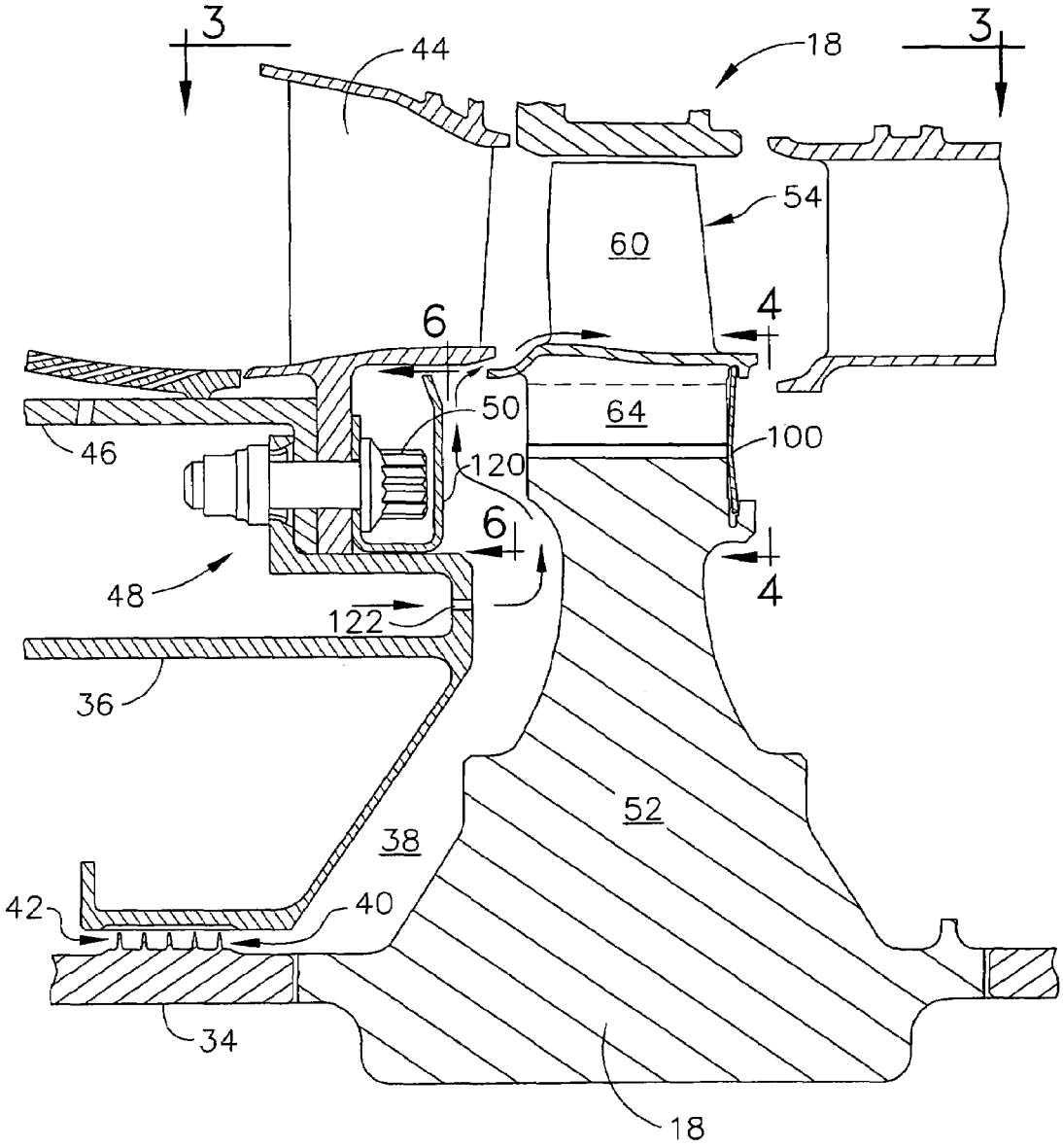
FIG. 2 is an enlarged cross-sectional view of a portion of the exemplary gas turbine engine shown in FIG. 1.
Figure 3:
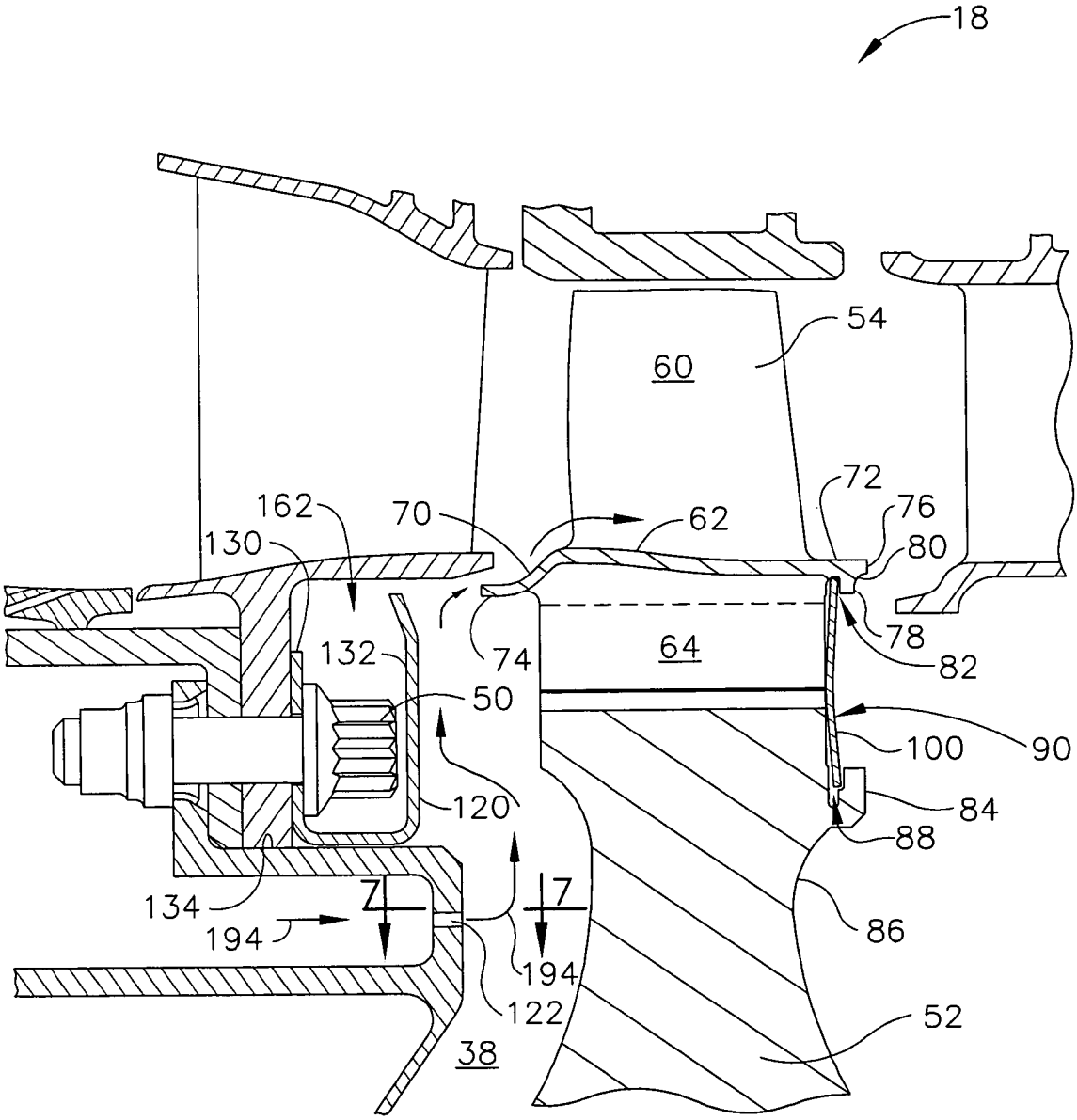
FIG. 3 an enlarged view of a portion of the gas turbine engine rotor disk shown in FIG. 2.
Figure 4:
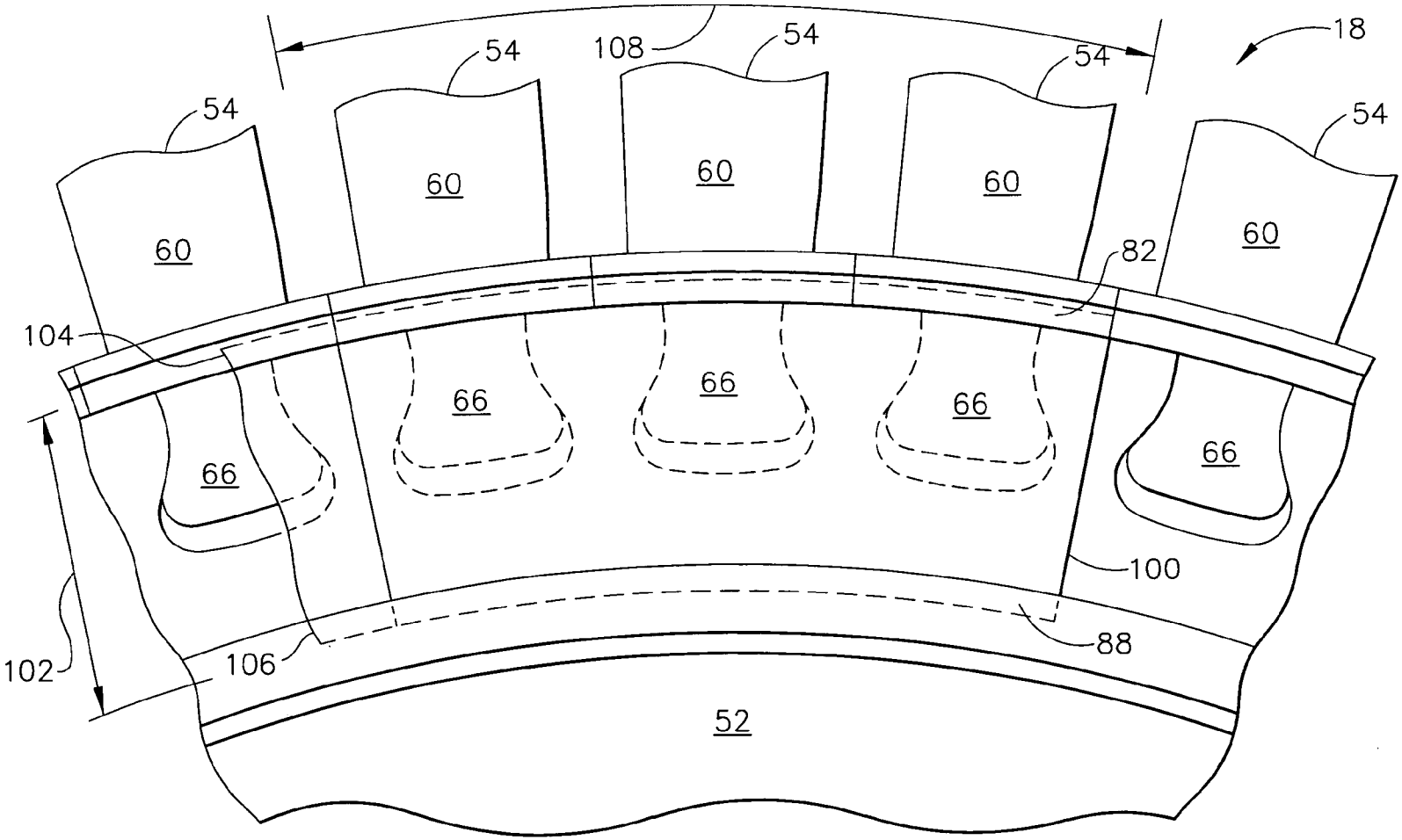
FIG. 4 is an end view of the gas turbine engine rotor disk shown in FIG. 3.

FIG. 2 is an enlarged cross-sectional view of a portion of high-pressure turbine assembly 18 (shown in FIG. 1). FIG. 3 an enlarged cross-sectional view of a portion of high-pressure turbine rotor assembly 18 (shown in FIG. 2). FIG. 4 is an end view of a portion of high-pressure turbine rotor assembly 18 (shown in FIG. 2).

In the exemplary embodiment, high-pressure turbine assembly 18 is coupled axially aft of a turbine mid-seal support structure 36 such that a cavity 38 is defined at least partially between mid-seal support structure 36 and high-pressure turbine assembly 18. Gas turbine engine 10 also includes a mid-frame labyrinth seal 40 that is coupled to mid-seal support structure 36 to facilitate reducing and/or eliminating air and/or fluid from being channeled through an opening 42 defined between a radially inner portion of mid-seal support structure 36 and shaft 34 into cavity 38. Moreover, gas turbine engine 10 includes a high-pressure turbine nozzle assembly 44 axially upstream from high-pressure turbine assembly 18 and a diffuser section 46. In the exemplary embodiment, at least a portion of diffuser section 46, high-pressure turbine nozzle assembly 44, and mid-seal support structure 36 are coupled together using a plurality of mechanical fasteners 48. In the exemplary embodiment, at last a portion of fastener 48, i.e. a bolt head 50 extends at least partially into cavity 38.

In the exemplary embodiment, high-pressure turbine assembly 18 includes a rotor disk 52 and a plurality of rotor blades 54 that are coupled to rotor disk 52. Rotor blades 54 extend radially outward from rotor disk 52, and each includes an airfoil 60, a platform 62, a shank 64, and a dovetail 66. Platform 62 extends between airfoil 60 and shank 64 such that each airfoil 60 extends radially outward from each respective platform 62. Shank 64 extends radially inwardly from platform 62 to dovetail 66. Dovetail 66 extends radially inwardly from shank 64 and facilitates securing each rotor blade 54 to rotor disk 52.

Platform 62 includes an upstream side or skirt 70 and a downstream side or skirt 72. Platform 62 also includes a forward angel wing 74, and an aft angel wing 76 which each extend outwardly from respective skirts 70 and 72. In the exemplary embodiment, each rotor blade 54 also includes a first portion 78 that extends radially inwardly from a lower surface 80 of aft angel wing 76 such that a first channel 82 is defined radially inwardly from each respective aft angel wing 76. Moreover, rotor disk 52 includes a substantially L-shaped portion 84 that is coupled to an aft face 86 of rotor disk 52 such that a second channel 88 is defined radially outwardly from rotor disk 52. In the exemplary embodiment, channel 82 is aligned substantially coaxially with channel 88 such that a cavity 90 is defined therebetween. In the exemplary embodiment, portion 84 is formed unitarily with rotor disk 52.

High-pressure turbine rotor assembly 18 further includes a plurality of blade retaining devices 100 that are utilized to secure plurality of rotor blades 54 to rotor disk 52. Each blade retaining device 100 has a width 102 that is selectively sized such that a radially outer edge 104 of blade retaining device 100 is positioned at least partially within channel 82 and a radially inner edge 106 of blade retaining device 100 is positioned at least partially within channel 88. Moreover, each blade retaining device 100 has a length 108 that is sized to secure at least one rotor blade 54 to rotor disk 52. In the exemplary embodiment, length 108 is selected to secure three rotor blades 54 to rotor disk 52. Moreover, although the exemplary embodiment illustrates each blade retaining device 100 securing three rotor blades 54 to rotor disk 52, it should be realized that length 108 can be selected to couple, one, two, three, or more rotor blades 54 to rotor disk 52.

In the exemplary embodiment, blade retaining devices 100 are each fabricated from a flexible metallic material. During installation radially outer edge 104 is positioned within channel 82, blade retaining device 100 is flexed and/or deformed such that radially inner edge 106 can be positioned within channel 88. Blade retaining device 100 then returns to its normal or unflexed condition to facilitate maintaining blade retaining device 100 within channels 82 and 88, respectively, and thus securing plurality of rotor blades 54 to rotor disk 52. To facilitate cooling high-pressure turbine assembly 18, gas turbine engine 10 further includes a bolt cover 120 and at least one opening 122 extending through turbine mid-seal support structure 36.

Figure 5:
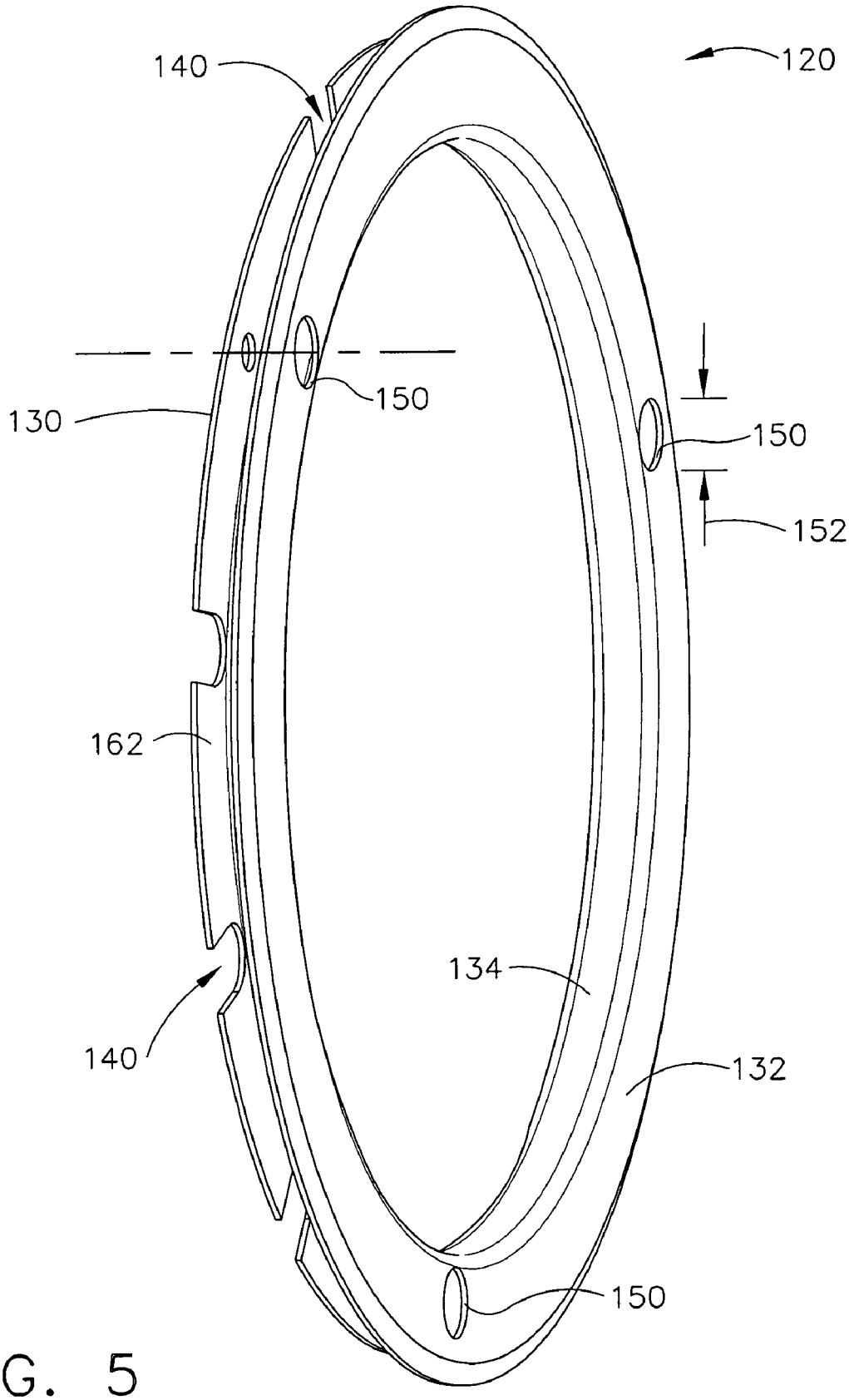
FIG. 5 is a perspective view of an exemplary bolt cover.
Figure 6:
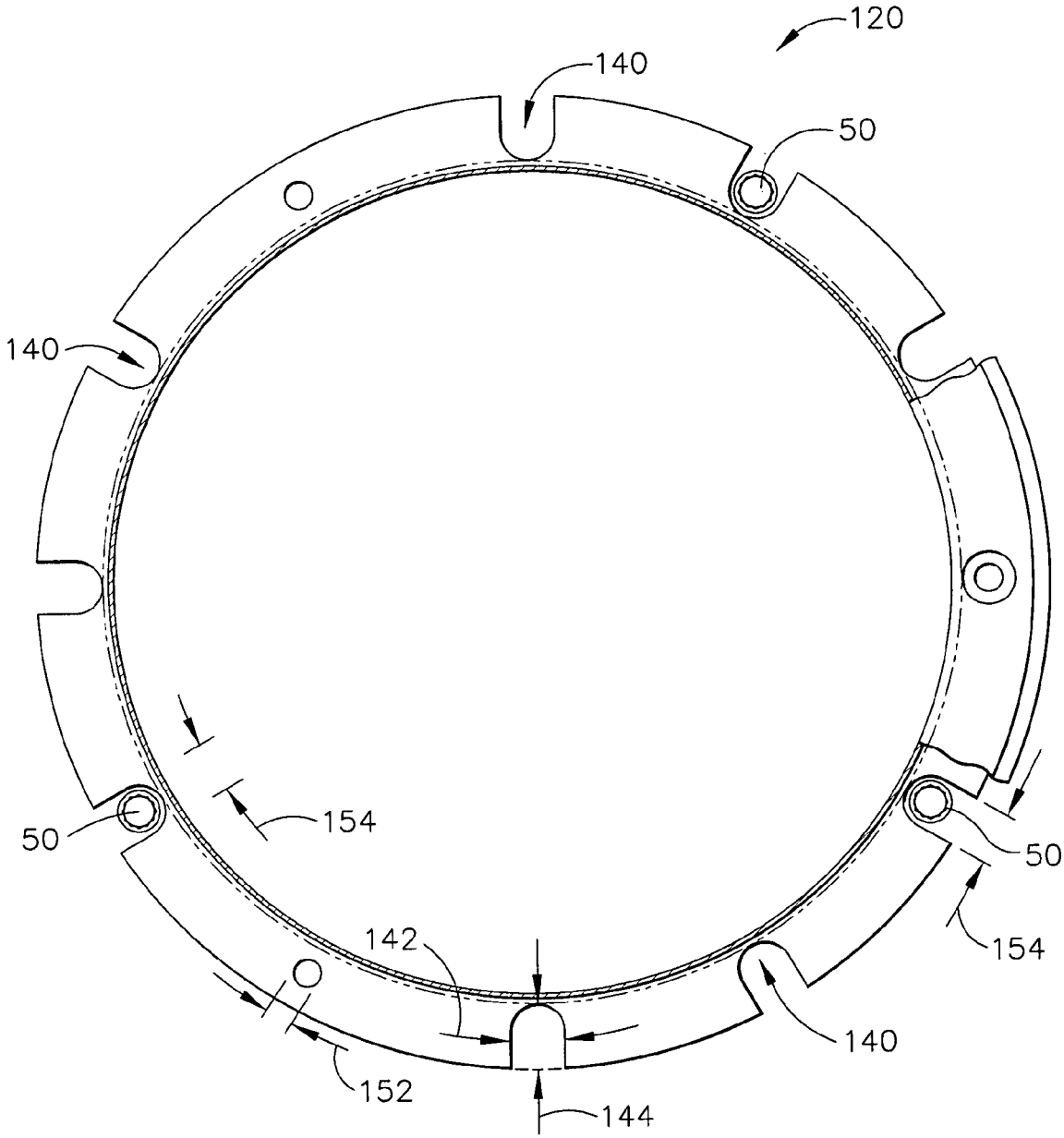
FIG. 6 is an end view of the bolt cover shown in FIG. 5.

FIG. 5 is a perspective view of bolt cover 120. FIG. 6 is an end view of bolt cover 120. In the exemplary embodiment, bolt cover 120 includes a first side 130, a second side 132 opposite first side 130, and a radially inner portion 134 that is coupled between first and second sides 130 and 132, respectively, Accordingly, and in the exemplary embodiment, bolt cover 120 has a substantially U-shaped cross-sectional profile. First side 130 includes a first quantity of slots 140 that are spaced circumferentially around a periphery of bolt cover 120. Each slot 140 has a width 142 and a length 144 that are each selectively sized to at least partially circumscribe a respective bolt head 50. More specifically, gas turbine engine 10 includes n bolts to facilitate coupling diffuser section 46, high-pressure turbine nozzle assembly 44, and mid-seal support structure 36 together. Accordingly, and in the exemplary embodiment, bolt cover 120 also includes n slots 140, wherein each slot 140 at least partially circumscribes a respective bolt head 50. In another embodiment, bolt cover 120 includes n-m slots 140, wherein m is defined as a quantity of fasteners 48 that are utilized to couple bolt cover 120 to mid-seal support structure 36 as discussed herein.

Bolt cover second side 132 includes m openings 150 extending therethrough. Each opening 150 has a diameter 152 that is less than a diameter 154 of a respective bolt head 50. In the exemplary embodiment, bolt cover 120 includes three openings 150, i.e. m=3. In the exemplary embodiment, bolt cover 120 is coupled within gas turbine engine 10 to facilitate covering bolt heads 50 and thereby improve cooling flow within cavity 38.

To install bolt cover 120, bolt cover 120 is positioned within gas turbine engine 10 such that plurality of slots 140 each at least partially circumscribe a respective bolt head 50. More specifically, slots 140 are selectively sized such that bolt cover 120 can be installed within gas turbine engine 10 without removing all of the fasteners 48. Accordingly, only m fasteners are removed and/or not installed. The m fasteners 48 are then inserted through respective openings 150 to facilitate coupling bolt cover 120 within gas turbine engine 10. Since each opening 150 is smaller than a respective bolt head 50, coupling a nut 160 to a respective fastener 48 facilitates securing bolt cover 120 within cavity 38. Since bolt cover 120 has a substantially U-shaped cross-sectional profile, bolt heads 50 are positioned within a cavity 162 that is defined between first side 130 and second side 132. Moreover, second side 132 facilitates channeling air around bolt heads 50 and thus facilitate reducing air turbulence within cavity 38 that would be-created with exposed bolt heads extending into cavity 38.

To facilitate cooling high-pressure turbine assembly 18, gas turbine engine 10 includes a plurality of openings 122 extending through turbine mid-seal support structure 36. More specifically, openings 122 extend through turbine mid-seal support structure 36 and into flow communication with cavity 38.

Figure 7:
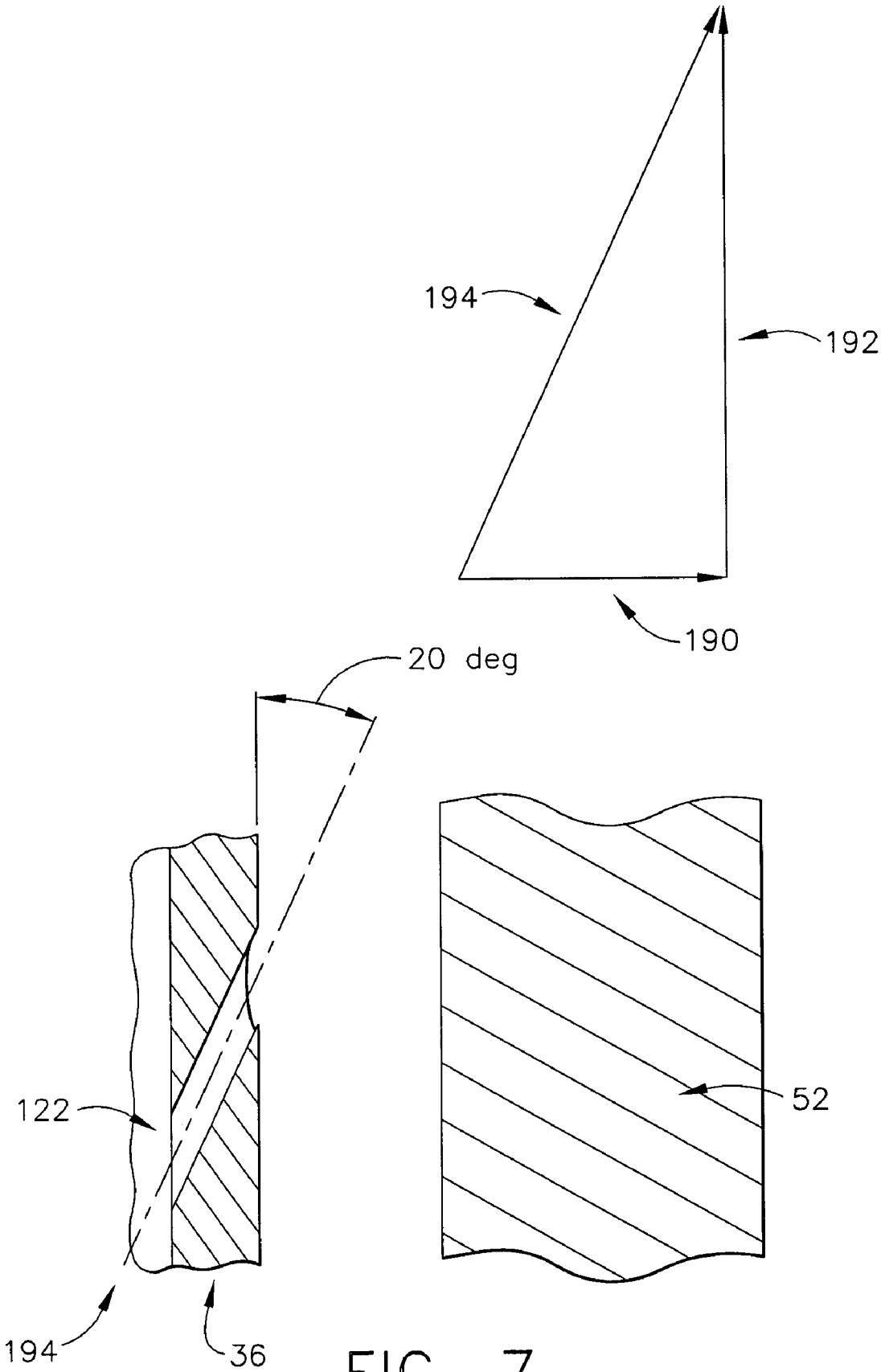
FIG. 7 is a cross-sectional view of a cooling opening shown in FIG. 2.

More specifically, and as shown in FIG. 7, each opening 122 includes an axially component 190 and a tangential component 192 such that a high relative tangential velocity is induced into cooling air 194 channeled through each opening 122. Swirl, as used herein, is defined as a ratio of the tangential cooling air velocity to the velocity of rotating high-pressure turbine assembly 18. More specifically, opening 122 facilitates increasing a velocity of cooling air 194 channeled through opening 122 to a velocity that is greater than the velocity of high-pressure turbine assembly 18 during operation.

In one embodiment, opening 122 is formed through turbine mid-seal support structure 36 at a tangential angle between approximately forty-five degrees and approximately 80 degrees with respect to centerline axis 11. In the exemplary embodiment, opening 122 is formed through turbine mid-seal support structure 36 at a tangential angle that is approximately seventy degrees with respect to centerline axis 11.

During operation, cooling air 194 is channeled through openings 122 to facilitate cooling high-pressure turbine assembly 18. More specifically, cooling air 194 is channeled through openings 122 an angle that is tangent to high-pressure turbine assembly 18 such that swirl is induced into cooling air 194. Cooling air 194 is then channeled over an exterior surface of bolt cover 120 which facilitates reducing and/or eliminating drag induced temperature rise (windage) that may be introduced into the cooling air caused by bolt heads 50. Additionally, blade retaining devices 100 facilitate reducing and/or eliminating airflow leakage through high-pressure turbine assembly 18 by substantially sealing any gaps that may exist between dovetail 66 and rotor 52.

The above-described high-pressure turbine rotor cooling system is cost-effective and highly reliable. The cooling system includes at least one opening to facilitate channeling cooling air into a cavity that is between the turbine mid-frame support and the high-pressure turbine rotor. The opening is formed such that the a swirling motion is imparted to the cooling air channeled therethrough. Moreover, the cooling system described herein includes a bolt cover to facilitate reducing turbulence within the cavity, and a plurality of blade retaining devices that are utilized to secure the rotor blades to the rotor disk and also to facilitate reducing and/or eliminating any airflow leakage that may occur between the turbine blades and the turbine rotor. As a result, the cooling air channeled into the cavity more effectively cools the high pressure turbine rotor compared to known cooling methods to facilitate extending a useful life of the rotor blades in a cost-effective and reliable manner.

While the invention has been described in terms of various specific embodiments, those skilled in the art will recognize that the invention can be practiced with modification within the spirit and scope of the claims.

What is claimed is:

1. A method of manufacturing a gas turbine engine comprising:

providing a turbine mid-frame;

coupling a plurality of rotor blades to a rotor disk, the rotor disk is coupled axially aft from the turbine mid-frame such that a cavity is defined between the rotor disk and the turbine mid-frame; and forming at least one opening that comprises an axial component and a tangential component, wherein the at least one opening extends through the turbine mid-frame to facilitate channeling cooling air into the gap, the opening configured to impart a high relative tangential velocity into the cooling air discharged from the opening, wherein the axial and tangential components are configured to impart a high relative tangential velocity into the cooling air discharged from the opening.

2. A method in accordance with claim 1 further comprising:

coupling a first substantially L-shaped channel to the rotor disk;

coupling a second substantially L-shaped channel to each rotor blade such that the rotor blade channels are aligned substantially axially with the rotor disk channel; and coupling at least one blade retaining device within the rotor disk channel and the at least one blade channel to facilitate securing at least one of the rotor blades to the rotor disk.

3. A method in accordance with claim 2 further comprising:

forming the substantially the first L-shaped channel unitarily with the rotor disk; and forming the second substantially L-shaped channel unitarily with each respective rotor blade.

4. A method in accordance with claim 1 further comprising:

coupling the turbine mid-frame to a diffuser using a plurality of fasteners, at least a portion of each of the fasteners extends into the gap; and coupling at least one fastener cover to the turbine mid-frame to facilitate reducing cooling air turbulence within the gap.

5. A method in accordance with claim 3 further comprising coupling at least one fastener cover having a substantially U-shaped cross-sectional profile to the turbine mid-frame.

6. A method in accordance with claim 5 further comprising coupling at least one fastener cover to the turbine mid-frame, wherein the at least one fastener cover includes a first quantity of slots, each of the slots having a first diameter that is greater than a diameter of each of the fasteners, a second side including a second quantity of openings that is fewer than said first quantity of slots, each said opening having a second diameter that is less than a diameter of at least a portion of the fastener, and a third side coupled between the first and second sides.

7. A turbine mid-frame assembly comprising:

a turbine mid-frame including at least one of a fastener cover plate and an opening extending through said turbine mid-frame configured to facilitate cooling a turbine coupled downstream from and adjacent to said turbine mid-frame, said opening is configured to impart a high relative tangential velocity into the cooling air discharged from said opening.

8. A turbine mid-frame assembly in accordance with claim 7 wherein said opening is configured to channel cooling air into a gap defined between said turbine and said turbine mid-frame.

9. A turbine mid-frame assembly in accordance with claim 7 wherein said turbine mid-frame assembly further comprises:

a plurality of fasteners used to couple said turbine mid-frame to a diffuser, at least a portion of each of said fasteners extends into said gap; and at least one fastener cover coupled to said turbine mid-frame, said fastener cover configured to facilitate reducing cooling air turbulence within said gap.

10. A turbine mid-frame assembly in accordance with claim 9 wherein said at least one fastener cover has a substantially U-shaped cross-sectional profile.

11. A turbine mid-frame assembly in accordance with claim 10 wherein said at least one fastener cover comprises:

a first side comprising a first quantity of slots, each of said slots having a first diameter that is greater than a diameter of each of said fasteners;

a second side comprising a second quantity of openings that is fewer than said first quantity of slots, each said opening having a second diameter that is less than a diameter of at least a portion of said fastener; and a third side coupled between said first and second sides.

12. A turbine mid-frame assembly in accordance with claim 11 wherein said turbine mid-frame comprises a first quantity of fasteners, a second quantity of slots that is equal to the first quantity of fasteners, and a third quantity of openings that is less than the first quantity of fasteners.

13. A gas turbine engine comprising:

a turbine mid-frame;

a high pressure turbine coupled aft of said turbine mid-frame such that a gap is defined between said turbine mid-frame and said high-pressure turbine; and at least one opening, comprising an axial component and a tangential component, said at least one opening extends through said turbine mid-frame to facilitate channeling cooling air into said gap, said opening configured to impart a high relative tangential velocity into the cooling air discharged from said opening, wherein said opening axial and tangential components are configured to impart a high relative tangential velocity into the cooling air discharged from the opening.

14. A gas turbine engine in accordance with claim 13 wherein said high-pressure turbine comprises:

a rotor disk;

a plurality of blades coupled to said rotor disk; and a plurality of blade retaining devices coupled to an aft face of said rotor disk and said plurality of blades, said blade retaining devices configured to secure said plurality of blades to said rotor disk.

15. A gas turbine engine in accordance with claim 14 wherein said rotor disk comprises a substantially L-shaped channel, each said blade comprises a substantially L-shaped channel aligned substantially axially with said rotor disk channel, said plurality of blade retaining devices coupled within said rotor disk channel and at least one blade channel to facilitate securing at least one of said blades to said rotor disk.

16. A gas turbine engine in accordance with claim 13 further comprising:

a plurality of fasteners used to couple said turbine midframe to a diffuser, at least a portion of each of said fasteners extends into said gap; and at least one fastener cover coupled to said turbine midframe, said fastener cover configured to facilitate reducing cooling air turbulence within said gap.

17. A gas turbine engine in accordance with claim 16 wherein said at least one fastener cover has a substantially U-shaped cross-sectional profile.

18. A gas turbine engine in accordance with claim 17 wherein said at least one fastener cover comprises:

a first side comprising a first quantity of slots, each of said slots having a first diameter that is greater than a diameter of each of said fasteners;

a second side comprising a second quantity of openings that is fewer than said first quantity of slots, each said opening having a second diameter that is less than a diameter of at least a portion of said fastener; and a third side coupled between said first and second sides.

* * * * *